US008782951B2

(12) United States Patent
Dickison

(10) Patent No.: US 8,782,951 B2
(45) Date of Patent: Jul. 22, 2014

(54) LOUVRE MOUNTING ASSEMBLY

(75) Inventor: Maxwell Dickison, Adelaide (AU)

(73) Assignee: Prodrome Designs Pty Ltd, Winnellie (AU)

( * ) Notice: Subject to any disclaimer, the term of this patent is extended or adjusted under 35 U.S.C. 154(b) by 16 days.

(21) Appl. No.: 13/136,363

(22) Filed: Jul. 29, 2011

(65) Prior Publication Data

US 2012/0025041 A1 Feb. 2, 2012

(30) Foreign Application Priority Data

Jul. 30, 2010 (AU) ..... 2010903416

(51) Int. Cl.
*E06B 7/086* (2006.01)

(52) U.S. Cl.
USPC ..... 49/91.1; 49/403; 49/92.1

(58) Field of Classification Search
USPC ..... 49/403, 74.1, 91.1, 92.1
See application file for complete search history.

(56) References Cited

U.S. PATENT DOCUMENTS

| | | | | | |
|---|---|---|---|---|---|
| 2,704,386 | A * | 3/1955 | Eaddy, Sr. | 49/310 |
| 2,751,642 | A * | 6/1956 | Klein | 49/80.1 |
| 2,779,068 | A * | 1/1957 | Blanchard | 49/371 |
| 2,805,453 | A * | 9/1957 | Petronello et al. | 49/490.1 |
| 2,890,503 | A * | 6/1959 | Paine | 49/371 |
| 2,952,882 | A * | 9/1960 | Reynaud | 49/249 |
| 3,290,823 | A * | 12/1966 | Matsuichi | 49/403 |
| 3,591,980 | A * | 7/1971 | Cheng | 49/91.1 |
| 4,043,258 | A * | 8/1977 | Zitko et al. | 454/319 |
| 4,294,283 | A * | 10/1981 | Scharres | 137/599.02 |
| 4,497,134 | A * | 2/1985 | Meyer et al. | 49/91.1 |
| 5,001,864 | A * | 3/1991 | Truscott | 49/403 |
| 5,560,147 | A * | 10/1996 | Ashida et al. | 49/74.1 |
| 5,930,952 | A * | 8/1999 | Ricci | 49/74.1 |
| 5,941,021 | A * | 8/1999 | Valls et al. | 49/92.1 |
| 6,098,339 | A * | 8/2000 | Rivera et al. | 49/74.1 |
| 6,098,340 | A * | 8/2000 | Francis | 49/74.1 |
| 7,963,071 | B2 | 6/2011 | Alexander et al. | 49/403 |
| 8,156,688 | B2 * | 4/2012 | Tan | 49/74.1 |
| 2005/0060940 | A1 * | 3/2005 | Alexander et al. | 49/403 |
| 2009/0113798 | A1 * | 5/2009 | Nieves Zeno | 49/92.1 |

FOREIGN PATENT DOCUMENTS

| | | | | |
|---|---|---|---|---|
| EP | 52173 | A1 * | 5/1982 | E06B 9/04 |
| EP | 512227 | A1 * | 11/1992 | E06B 7/086 |

* cited by examiner

*Primary Examiner* — Jerry Redman
(74) *Attorney, Agent, or Firm* — Gerald T. Bodner

(57) ABSTRACT

A sealing member for a louvre mounting assembly is described. The louvre mounting assembly is of the type to allow co-rotation of at least first and second louvre panes between open and closed positions. The sealing member located in an end clip for the first louvre pane of the louvre mounting assembly, wherein the sealing member includes a first sealing region for sealing against a portion of the second louvre pane to seal against movement of liquid into the end clip when the louvre mounting assembly is in a closed position.

8 Claims, 4 Drawing Sheets

LOUVRE MOUNTING ASSEMBLY

CLAIM OF PRIORITY

The present application for patent claims priority from Australian Provisional Patent Application No. 2010903416 entitled "Louvre Mounting Assembly", filed 30 Jul. 2010, which is hereby expressly incorporated by reference herein in its entirety.

TECHNICAL FIELD

The present invention relates to louvre window assemblies. In a particular form, the present invention relates to the mounting of louvres in a louvre mounting assembly.

BACKGROUND

Louvre window assemblies incorporating a number of horizontally oriented louvre panes which co-rotate together about a horizontal axis from an open position to a closed position provide a convenient and cost effective arrangement which can allow precise variation of the amount of air that passes through an aperture such as a window. Typically a louvre pane is formed from glass or other transparent material but equally it may be an opaque or semi-transparent material so as to provide variable shading.

These louvre panes are typically mounted in a louvre mounting assembly consisting of opposed end clips with each end clip having a receiving region generally in the form of a channel or groove which receives the respective ends of the louvre pane and which are rotatable within the side frame of the window. Various mechanisms are known which link a number of louvre panes to cause co-rotation of the respective end clips so that movement of a handle or an actuator results in the louvre panes of the louvre window assembly opening and closing together.

A long standing problem with louvre mounting assemblies of this type is their performance under inclement weather conditions and in particular their sealability with respect to the ingress of rain into the louvre mounting assembly and then potentially into the interior of the window. This problem is exacerbated by strong storm, hurricane or cyclonic conditions where any rain is also accompanied by strong winds. These conditions often cause water to bead and travel along the louvre pane and migrate into the louvre mounting assembly. This can result in water leaking into the interior of a building or structure where the louvre window assembly is located. In addition, the entry of water into the louvre mounting assembly or end clips can cause corrosion or enhanced wear of the rotating mechanism.

There is therefore a need for a means to improve the sealing characteristics of a louvre mounting assembly particularly under inclement weather conditions.

SUMMARY

In a first aspect, the present invention accordingly provides a sealing member for a louvre mounting assembly, the louvre mounting assembly operative to allow co-rotation of at least first and second louvre panes between open and closed positions, the sealing member located in an end clip for the first louvre pane of the louvre mounting assembly, wherein the sealing member includes a first sealing region for sealing against a portion of the second louvre pane to seal against movement of liquid into the end clip when the louvre mounting assembly is in a closed position.

In another form, the sealing member is located in a portion of the end clip that extends over the second pane.

In another form, the first sealing region is oriented substantially perpendicularly to a longitudinal axis as defined by the at least first and second louvre panes.

In another form, the first sealing region includes a rib portion.

In another form, the rib portion extends from the end clip towards the second louvre pane when the louvre mounting assembly is in a closed position.

In another form, the first sealing region is formed of a resilient material.

In another form, the sealing member is removably mounted to the end clip.

In another form, the sealing member is integrally formed into the end clip.

In another form, the sealing member includes a second sealing region, the second sealing region for sealing against an edge of a first louvre pane to seal against movement of liquid along the edge into the end clip.

In another form, the second sealing region extends along substantially the full thickness of the first louvre pane.

In another form, the second sealing region includes a rib portion.

In another form, the second sealing region is formed of a resilient material.

In another form, the panes are aligned substantially horizontally and the sealing member is located in a bottom portion of the end clip.

In a second aspect, the present invention accordingly provides a louvre mounting assembly for mounting a plurality of louvre panes to allow co-rotation of the louvre panes by an actuator, the louvre mounting assembly including opposed end clips for mounting a respective louvre pane, wherein the opposed end clips include sealing members each having a first sealing region that seals against one or more adjacent louvre panes of the respective louvre pane to seal against movement of liquid along the respective louvre pane or the one or more adjacent louvre panes into the opposed end clips when the louvre mounting assembly is in a closed position.

In another form, the sealing member is located in a portion of the end clip that extends over an adjacent louvre pane.

In another form, the sealing member includes a second sealing region, the second sealing region for sealing against an edge of the respective louvre pane mounted by the end clips to seal against movement of liquid along the edge of the respective louvre pane into the end clip.

In another form, the second sealing region extends along substantially the full thickness of the respective louvre pane.

In a third aspect, the present invention accordingly provides an end clip for a louvre mounting assembly, the louvre mounting assembly operative to allow co-rotation of at least first and second louvre panes between open and closed positions, wherein the end clip includes a mounting portion, the mounting portion for removably mounting a sealing member, wherein the sealing member includes a first sealing region for sealing against a portion of the second louvre pane to seal against movement of liquid into the end clip when the louvre mounting assembly is in a closed position.

In another form, the sealing member removably mounted to the end clip includes a second sealing region, the second sealing region for sealing against an edge of the first louvre pane mounted by the end clip to seal against movement of liquid along the edge of the first louvre pane into the end clip.

In another form, the second sealing region extends along substantially the full thickness of the first louvre pane.

BRIEF DESCRIPTION OF THE DRAWINGS

Illustrative embodiments of the present invention will be discussed with reference to the accompanying drawings wherein.

In the following description, like reference characters designate like or corresponding parts throughout the several views of the drawings.

DETAILED DESCRIPTION

Figure 1A:
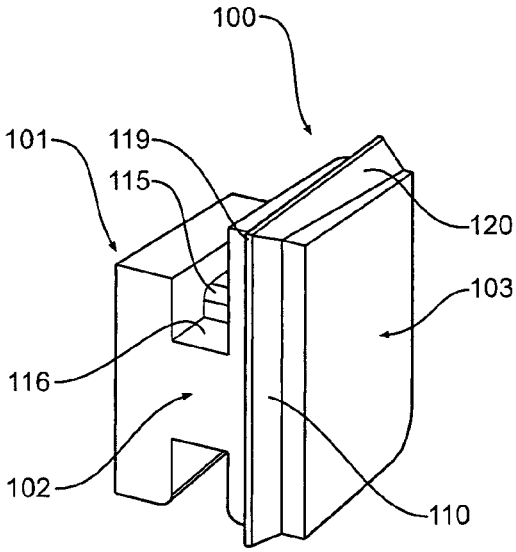
FIGS. 1*a*-1*d* are various views of a sealing member in accordance with an illustrative embodiment of the present invention.
Figure 1B:
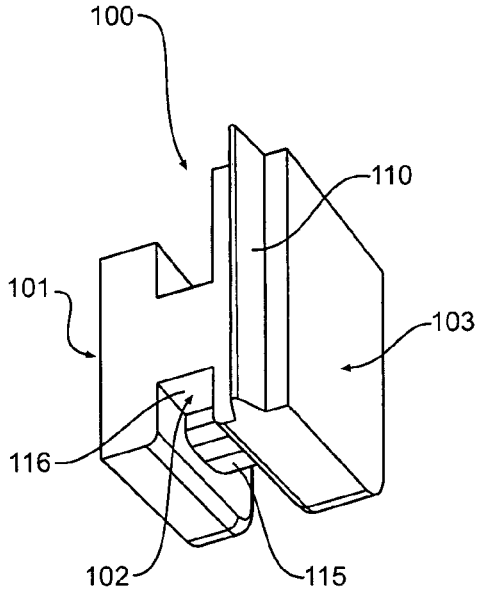
Figure 1C:
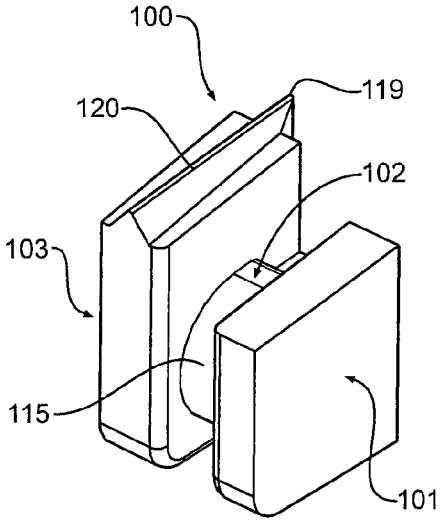
Figure 1D:
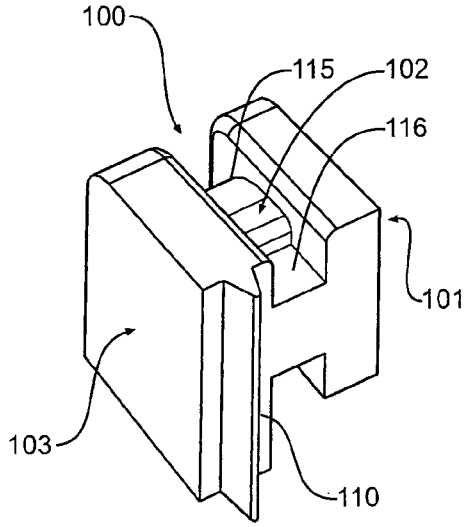

Referring now to FIGS. 1*a*-1*d*, there are shown various views of a sealing member 100 according to an illustrative embodiment of the present invention. FIG. 1*a* is a front perspective view of sealing member 100; while FIG. 1*b* shows an underside view; FIG. 1*c* depicts a rear view, and FIG. 1*d* shows a flipped perspective view depicting the underside of sealing member 100 on the top of the diagram.

For ease of description, the sealing member 100 embodying the present invention is described below in its usual assembled position as shown in the accompanying drawings and terms such as front, rear, upper, lower, horizontal, longitudinal etc., may be used with reference to this usual position. However, the sealing member may be manufactured, transported, sold, or used in orientations other than that described and shown herein.

In this illustrative embodiment, sealing member 100 is formed as an integrally moulded item having a generally "H" shaped configuration consisting of opposed first and second side portions 101, 103 joined by a stem or neck portion 102 extending between side portions 101, 103. As shown in FIG. 1*a* side portions 101, 103 are formed as rectangular prism elements with side portion 103 larger than opposed side portion 101. Neck portion 102 consists of a first part circular region 115 extending between the inner faces of side portion 101, 103 which terminates in top and bottom horizontal shelf or ledge portions 116.

Sealing member 100 includes a first sealing region in the form of an outwardly extending tapered rib portion 110 which runs longitudinally along the front face of side portion 103 (as depicted in FIG. 1*a*). Sealing member 100 further includes a second sealing region once again in the form of an outwardly extending tapered rib portion 120 which runs longitudinally along the top face of side portion 103 (as depicted in FIG. 1*a*). In this illustrative embodiment, first or second sealing regions or respective tapered rib portions 110, 120 are joined at corner region 119 but alternatively sealing regions may be configured independently of each other depending on requirements.

In this illustrative embodiment, sealing member 100 is formed of a waterproof resilient material such as a rubber compound or synthetic equivalent. Other suitable materials include, but are not limited to, elastomeric polypropylene or polyethylene, flexible PVC, thermoplastic elastomers such as Santoprene™ or silicone rubber. In addition, sealing regions 110, 120 may be in the form of a thin lip or tab that is compressible or flexible due to its thickness. However, as would appreciated by those of ordinary skill in the art sealing member 100 need not be formed of a resilient elastomeric material and that depending on the circumstances, sealing member 100 and/or first and second sealing regions 110, 120 may be formed of a suitable water resistant material such as a thermoplastic material for example.

Figure 2:
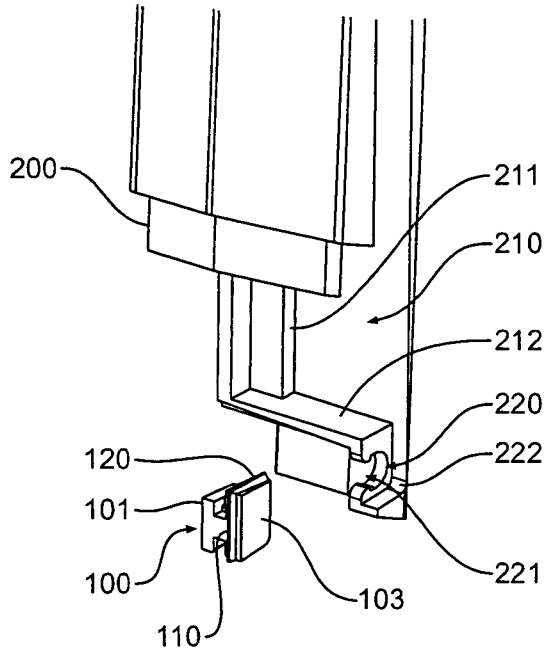
FIG. 2 is a rear perspective view of an end clip for a louvre pane prior to the mounting of the sealing member as illustrated in FIGS. 1*a*-1*d;*
Figure 3:
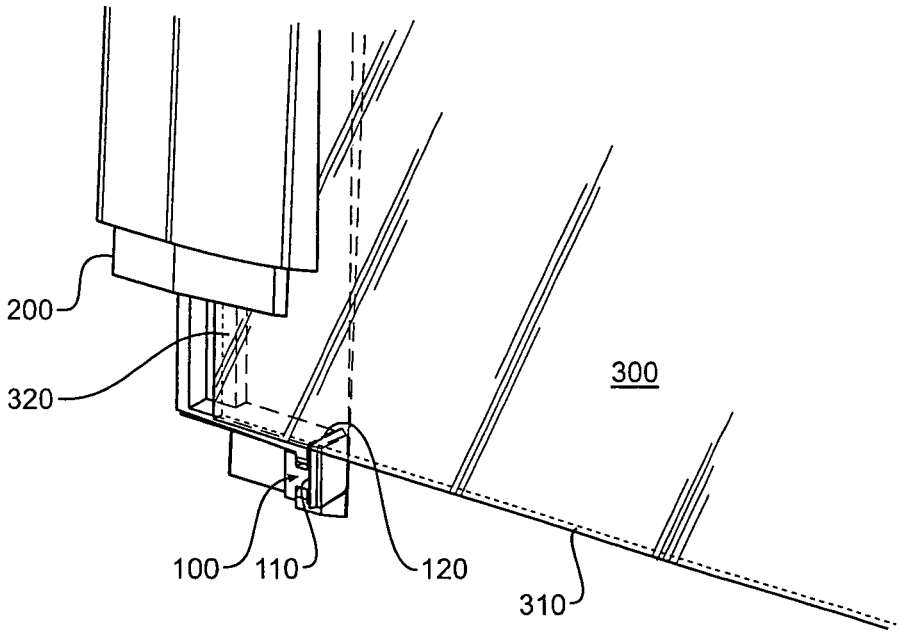
FIG. 3 is an assembled view of the end clip illustrated in FIG. 2 after insertion of a louvre pane into the end clip.

Referring now to FIGS. 2 and 3, there is shown a rear view of the lower portion of a louvre end clip 200 incorporating the sealing member 100 as illustrated in FIGS. 1*a*-1*d* first in a disassembled configuration (FIG. 2) and then in an assembled configuration (FIG. 3). End clip 200 includes a receiving region 210 for receiving a louvre pane 300 that includes a side abutment portion 211 and a bottom shelf or ledge 212 which supports the louvre pane 300.

In accordance with the present invention, end clip 200 further includes a mounting region 220 that is located on a portion of the end clip 200 that will in use extend over the next louvre pane. In this illustrative embodiment, mounting region 220 is formed as a part circular open ended aperture 221 having a complementary shape to the part circular region 115 of neck portion 102 that functions to receive and locate about the part circular region 115 and abuts against the shelf portions 116 of neck portion 102 to removably retain sealing member 100 with respect to end clip 200. Side portion 103 is also of a complementary shape to the associated abutment 222 region in end clip 200 to facilitate location of sealing member 100.

In this manner, sealing member 100 may be removably mounted to end clip 200, thereby facilitating assembly of the end clip 200 or replacement of sealing member 100 in the event of wearing. As would be appreciated by those of ordinary skill in the art, all manner of attachment or means of mounting of sealing member 100 to end clip 200 are contemplated to be within the scope of the invention including, but not limited to, permanent attachment arrangements employing adhesives or ultrasonic welding and the like.

Figure 4:
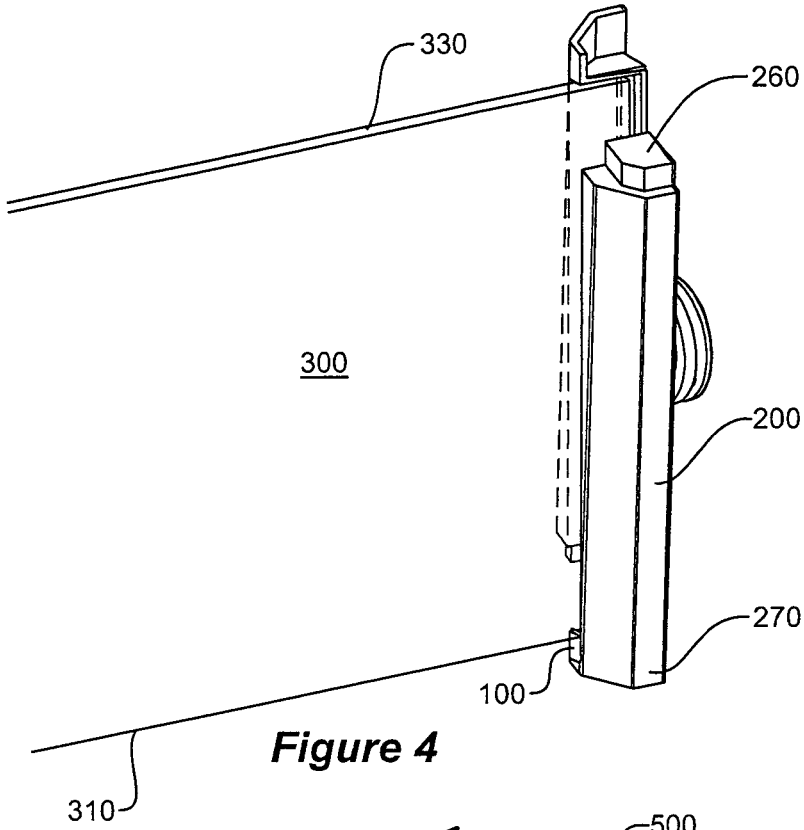
FIG. 4 is a front perspective view of the assembled end clip as illustrated in FIG. 3.

While in this illustrative embodiment, sealing member 100 has been formed as a separate unitary member to end clip 200, in other embodiments sealing member may be co-moulded into or form part of end clip 200. FIG. 4 shows a front perspective view of a single louvre pane 300 mounted in end clip 200 indicating the location in this illustrative embodiment of sealing member 100 at the bottom or lower portion of end clip 200. As mounting region 220 is located in a portion of end clip 200 below the lower edge 310 of louvre pane 300 the lower edge 310 of louvre pane 300 will be seated on rib portion 120 (as best seen in FIG. 3) that extends in this illustrative embodiment along substantially the full thickness of louvre pane 300.

Figure 5:
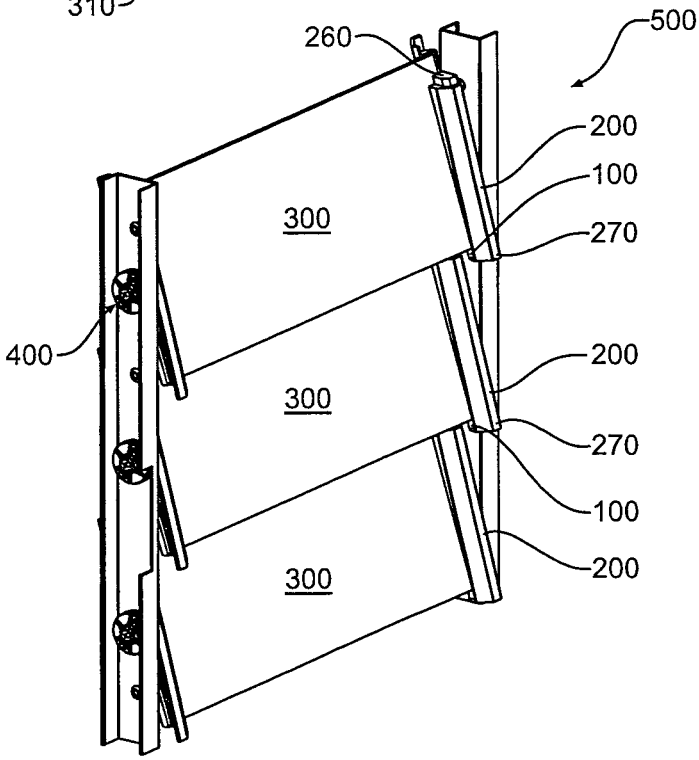
FIG. 5 is a front perspective view of a partially open louvre window assembly including a louvre mounting assembly consisting of a number of the assembled end clips illustrated in FIG. 4.
Figure 6:
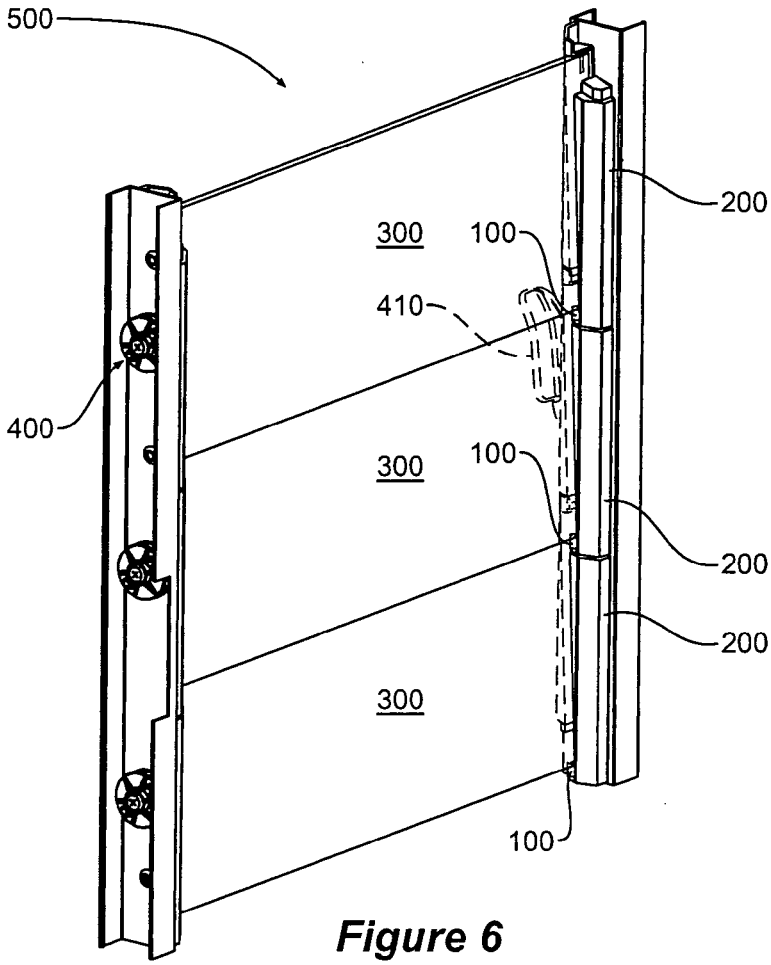
FIG. 6 is a front perspective view of a the louvre window assembly illustrated in FIG. 5 in a closed position.

Referring now to FIGS. 5 and 6, there are shown front perspective views of a louvre window assembly 500 consisting of a plurality of louvre panes 300 that are mounted in a louvre mounting assembly 400 as known in the art which allows co-rotation of the louvre panes by the action of actuator or lever arm 410 or the like. FIG. 5 depicts the louvre window assembly 500 in a partially open configuration whereas FIG. 6 depicts the louvre window assembly 500 in a closed configuration. In this illustrative embodiment, the external faces of end clips 200 form a generally contiguous surface running along the side edges of louvre panes 300 when in the closed configuration. To facilitate alignment, each end clip 200 includes an overhang portion 270 which in a closed position covers a complementary shaped projection 260 formed on the top of the next end clip 200.

Figure 7:
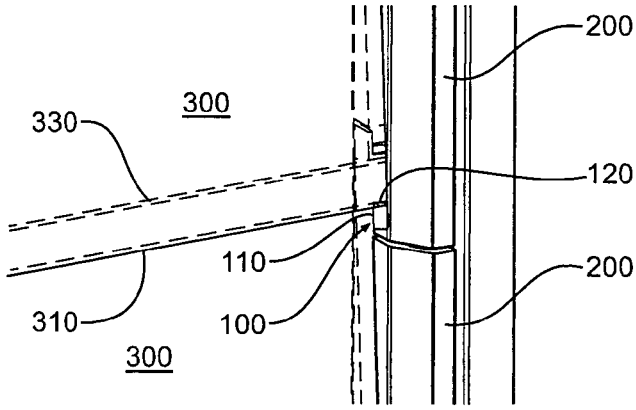
FIG. 7 is a detailed view of louvre window assembly illustrated in FIG. 6 showing the sealing member illustrated in FIGS. 1*a*-1*d* sealing against a portion of the next louvre pane.

Referring now to FIG. 7, there is shown a detailed view of the operation of sealing member 100 when louvre window assembly 500 is in a closed configuration as shown in FIG. 6. As described previously, sealing member 100 includes a first sealing region 110 which in this illustrative embodiment includes a rib portion which extends from end clip 200 towards the louvre pane 300 when the louvre mounting assembly 400 is in a closed configuration and which abuts against a portion near the top edge 330 of the next louvre pane below. In this manner, sealing region 110 seals against the movement of any water that beads and migrates or runs along the lower edge 310 of the louvre pane 300 into end clip 200 and then from further entering louvre mounting assembly 400.

As water is prevented from moving and entering respective end clips 200 this will result in the water being directed downwardly where it will eventually run off at the bottom of the louvre window assembly 500. As a further aid to prevent the ingress or migration of water into end clips 200, the additional sealing region or rib portion 120 functions to seal against movement of water or liquid along the lower edge 310 of louvre pane 300 and entering end clip 200.

As would be appreciated by those of ordinary skill in the art, a louvre mounting assembly including a sealing member in accordance with the present invention reduces the amount of water that can potentially enter into the end clips of a louvre mounting assembly thereby reducing the likelihood of corrosion and wear. While the embodiments described herein have been directed to the sealing member being located in the lower portion of respective end clips equally they could be located at the top portions, or both top and bottom portions of an end clip to form co-operating sealing regions to seal against movement of liquid along the edges of a respective louvre pane from entering the end clip. Similarly, while the present illustrative embodiments have been described with respect to horizontal louvre arrangements the present invention may also be applied to vertically oriented or tilted louvre arrangements.

The reference to any prior art in this specification is not, and should not be taken as, an acknowledgement of any form of suggestion that such prior art forms part of the common general knowledge.

Although illustrative embodiments of the present invention have been described in the foregoing detailed description, it will be understood that the invention is not limited to the embodiment disclosed, but is capable of numerous rearrangements, modifications and substitutions without departing from the scope of the invention as set forth and defined by the following claims.

The claims defining the invention are as follows:

1. A louvre assembly, which comprises:

a plurality of louvre panes, each louvre pane of the plurality of louvre panes having a top edge, a bottom edge disposed opposite the top edge, a front face and a rear face disposed opposite the front face, and opposite lateral side edges joined to the top edge and the bottom edge, the plurality of louvre panes including at least a first louvre pane and a second louvre pane situated adjacent to the first louvre pane;

a plurality of pairs of oppositely disposed side end clips, each side end clip of the plurality of pairs of side end clips receiving a respective lateral side edge of a corresponding louvre pane of the plurality of louvre panes, the plurality of pairs of oppositely disposed side end clips including at least a first pair of oppositely disposed side end clips which receive the respective side edges of the first louvre pane of the plurality of louvre panes;

an actuator operatively linked to the plurality of pairs of side end clips, the actuator rotating the plurality of pairs of side end clips and the plurality of louvre panes between an open position and a closed position; and a plurality of sealing members, each sealing member being mounted on a respective side end clip of the plurality of side end clips, each sealing member including at least one sealing region, the plurality of sealing members including first sealing members mounted on the side end clips of the first pair of oppositely disposed side end clips, the at least one sealing region of the first sealing members engaging at least one of the first louvre pane and the second louvre pane of the plurality of louvre panes and preventing or at least minimizing the ingress of water into the side end clips of the first pair of oppositely disposed side end clips when the plurality of louvre panes is at least in the closed position.

2. The louvre assembly defined by claim 1, wherein the at least one sealing region of the first sealing members engages at least one of the front face of the second louvre pane of the plurality of louvre panes and the bottom edge of the first louvre pane of the plurality of louvre panes when the plurality of louvre panes is at least in the closed position.

3. A louvre mounting assembly to mount thereon a plurality of louvre panes, each louvre pane of the plurality of louvre panes having a top edge, a bottom edge disposed opposite the top edge, a front face and a rear face disposed opposite the front face, and opposite lateral side edges joined to the top edge and the bottom edge, the plurality of louvre panes including at least a first louvre pane and a second louvre pane situated adjacent to the first louvre pane, the louvre mounting assembly comprising:

a plurality of pairs of oppositely disposed side end clips, each side end clip of the plurality of pairs of side end clips receiving a respective lateral side edge of a corresponding louvre pane of the plurality of louvre panes when the plurality of louvre panes is mounted on the assembly, the plurality of pairs of oppositely disposed side end clips including at least a first pair of oppositely disposed side end clips which receive the respective side edges of the first louvre pane of the plurality of louvre panes when the plurality of louvre panes is mounted on the assembly;

an actuator operatively linked to the plurality of pairs of side end clips, the actuator rotating the plurality of pairs of side end clips and the plurality of louvre panes between an open position and a closed position when the plurality of louvre panes is mounted on the assembly; and a plurality of sealing members, each sealing member being mounted on a respective side end clip of the plurality of side end clips, each sealing member including at least one sealing region, the plurality of sealing members including first sealing members mounted on the side end clips of the first pair of oppositely disposed side end clips, the at least one sealing region of the first sealing members being engagable with at least one of the first louvre pane and the second louvre pane of the plurality of louvre panes when the plurality of louvre panes is mounted on the assembly and preventing or at least minimizing the ingress of water into the side end clips of the first pair of oppositely disposed side end clips when the plurality of louvre panes is mounted on the assembly and is at least in the closed position.

4. The louvre mounting assembly defined by claim 3, wherein the at least one sealing region of the first sealing members is engagable with at least one of the front face of the second louvre pane of the plurality of louvre panes and the bottom edge of the first louvre pane of the plurality of louvre panes when the plurality of louvre panes is mounted on the assembly and is at least in the closed position.

5. A louvre assembly, which comprises:

a plurality of louvre panes, each louvre pane of the plurality of louvre panes having a top edge, a bottom edge disposed opposite the top edge, a front face and a rear face disposed opposite the front face, and opposite lateral side edges joined to the top edge and the bottom edge, the plurality of louvre panes including at least a first louvre pane and a second louvre pane situated adjacent to the first louvre pane;

a plurality of pairs of oppositely disposed side end clips, each side end clip of the plurality of pairs of side end clips receiving a respective lateral side edge of a corresponding louvre pane of the plurality of louvre panes, the plurality of pairs of oppositely disposed side end clips including at least a first pair of oppositely disposed side end clips which receive the respective side edges of the first louvre pane of the plurality of louvre panes;

an actuator operatively linked to the plurality of pairs of side end clips, the actuator rotating the plurality of pairs of side end clips and the plurality of louvre panes between an open position and a closed position; and a plurality of sealing members, each sealing member being mounted on a respective side end clip of the plurality of side end clips, each sealing member including a first sealing region and a second sealing region, the plurality of sealing members including first sealing members mounted on the side end clips of the first pair of oppositely disposed side end clips, the first sealing region of the first sealing members engaging the second louvre pane of the plurality of louvre panes when the plurality of louvre panes is in the closed position, and the second sealing region of the first sealing members engaging the first louvre pane of the plurality of louvre panes.

6. The louvre assembly defined by claim 5, wherein the first sealing region of the first sealing members engages the front face of the second louvre pane of the plurality of louvre panes when the plurality of louvre panes is in the closed position, and wherein the second sealing region of the first sealing members engages the bottom edge of the first louvre pane of the plurality of louvre panes.

7. A louvre mounting assembly to mount thereon a plurality of louvre panes, each louvre pane of the plurality of louvre panes having a top edge, a bottom edge disposed opposite the top edge, a front face and a rear face disposed opposite the front face, and opposite lateral side edges joined to the top edge and the bottom edge, the plurality of louvre panes including at least a first louvre pane and a second louvre pane situated adjacent to the first louvre pane, the louvre mounting assembly comprising:

a plurality of pairs of oppositely disposed side end clips, each side end clip of the plurality of pairs of side end clips receiving a respective lateral side edge of a corresponding louvre pane of the plurality of louvre panes when the plurality of louvre panes is mounted on the assembly, the plurality of pairs of oppositely disposed side end clips including at least a first pair of oppositely disposed side end clips which receive the respective side edges of the first louvre pane of the plurality of louvre panes when the plurality of louvre panes is mounted on the assembly;

an actuator operatively linked to the plurality of pairs of side end clips, the actuator rotating the plurality of pairs of side end clips and the plurality of louvre panes between an open position and a closed position when the plurality of louvre panes is mounted on the assembly; and a plurality of sealing members, each sealing member being mounted on a respective side end clip of the plurality of side end clips, each sealing member including a first sealing region and a second sealing region, the plurality of sealing members including first sealing members mounted on the side end clips of the first pair of oppositely disposed side end clips, the first sealing region of the first sealing members being engagable with the second louvre pane of the plurality of louvre panes when the plurality of louvre panes is mounted on the assembly and is in the closed position, and the second sealing region of the first sealing members being engagable with the first louvre pane of the plurality of louvre panes when the plurality of louvre panes is mounted on the assembly.

8. The louvre mounting assembly defined by claim 7, wherein the first sealing region of the first sealing members is engagable with the front face of the second louvre pane of the plurality of louvre panes when the plurality of louvre panes is mounted on the assembly and is in the closed position, and wherein the second sealing region of the first sealing members engages the bottom edge of the first louvre pane of the plurality of louvre panes when the plurality of louvre panes is mounted on the assembly.

* * * * *